US005208941A

United States Patent [19]

Ettere

[11] Patent Number: 5,208,941

[45] Date of Patent: May 11, 1993

[54] HIGH POWER VACUUM ATTACHMENT APPARATUS

[76] Inventor: Mark Ettere, 456 Victoria Ave., Piscataway, N.J. 08854

[21] Appl. No.: 902,831

[22] Filed: Jun. 23, 1992

[51] Int. Cl.[5] ..... A47L 9/02

[52] U.S. Cl. ..... 15/401; 15/418; 15/419

[58] Field of Search ..... 15/321, 401, 418, 419, 15/421, 1.7, 340.1

[56] References Cited

U.S. PATENT DOCUMENTS

| | | | |
|---|---|---|---|
| 1,107,564 | 8/1914 | Ward | 15/419 X |
| 1,186,079 | 6/1916 | Cooley | 15/340.1 X |
| 1,196,414 | 8/1916 | Zimmer | 15/419 X |
| 1,219,763 | 3/1917 | Pearce | 15/419 X |
| 1,268,963 | 6/1918 | Gray | 15/419 X |
| 1,651,585 | 12/1927 | Clair | 15/419 X |
| 1,883,327 | 10/1932 | Becker | 15/418 |
| 2,142,502 | 1/1939 | Edström | 15/418 |
| 2,335,448 | 11/1943 | Ross | 15/419 X |
| 2,496,028 | 1/1950 | Wells | 15/418 X |
| 2,619,669 | 12/1952 | Cuddeback | 15/418 X |
| 2,904,816 | 9/1959 | Skolfield | 15/419 X |
| 3,048,876 | 8/1962 | Kemnitz | 15/421 X |
| 3,135,986 | 6/1964 | Tolin | 15/419 X |
| 3,491,399 | 1/1970 | Dolan et al. | 15/418 X |
| 3,675,266 | 7/1972 | Murray et al. | 15/340.1 X |
| 3,750,221 | 8/1973 | Meyerhoefer | 15/419 X |
| 3,862,469 | 1/1975 | Burgoon | 15/418 X |
| 3,881,215 | 5/1975 | Krier et al. | 15/340.1 |
| 3,938,217 | 2/1976 | Hommes | 15/419 X |
| 3,942,216 | 3/1976 | Minton | 15/419 X |
| 4,014,065 | 3/1977 | Hudson | 15/419 X |
| 4,395,794 | 8/1983 | Duncan | 15/340.1 X |
| 4,557,013 | 12/1985 | Belmont | 15/419 X |
| 4,827,559 | 5/1989 | Norland | 15/418 X |
| 4,831,684 | 5/1989 | Duncan | 15/340.1 |

FOREIGN PATENT DOCUMENTS

| | | | |
|---|---|---|---|
| 53830 | of 1912 | Australia | 15/419 |
| 2916009 | 10/1980 | Fed. Rep. of Germany | 15/340.1 |
| 86/01240 | 2/1986 | PCT Int'l Appl. | 15/421 |
| 86/02394 | 4/1986 | PCT Int'l Appl. | 15/340.1 |
| 621170 | 1/1981 | Switzerland | 15/418 |
| 794491 | 5/1958 | United Kingdom | 15/340.1 |
| 1060825 | 3/1967 | United Kingdom | 15/340.1 |

*Primary Examiner*—Stephen F. Gerrity
*Attorney, Agent, or Firm*—Kenneth P. Glynn

[57] ABSTRACT

The present invention involves a high power vacuum attachment apparatus with infinite adjustability and includes a housing with side walls, a top and a back, and with an open front and an open bottom. A gate located within the housing divides it into two compartments and is slidably mounted so as to be moved up and down within the housing. The top of the housing has an orifice through which an adjustment mechanism passes and is connected to the gate. Preferably, the side walls have a greater width at the open front than at the rear wall so as to taper rearwardly. Also, this attachment may include a vacuum pipe connected to the housing which functions as a handle, a vacuum line and may include an adjustable air valve. In preferred embodiments, squeegees are included along the bottoms of the housing walls.

18 Claims, 4 Drawing Sheets

HIGH POWER VACUUM ATTACHMENT APPARATUS

BACKGROUND OF THE INVENTION

1. Field of the Invention

The present invention is directed to a high power vacuum attachment apparatus. It is a unique apparatus involving a housing with both an open bottom and an open front and includes a movable gate to act as an intake control as well as a safety device. It is typically attached to high power vacuum systems, such as fluid vacuums for commercial use, such as for removing liquid from the bottom of storage facilities. It is particularly advantageous for removal of liquid in shallow pools where three or four inch diameter nozzles intake air.

2. Prior Art Statement

Vacuuming has been available for decades. Conventional home cleaning systems include built-in units, hand carrying units, uprights and canister units, etc. These, however, are very different from high power units which are used to remove fluids in commercial applications. For example, the evacuation of liquids of low to high viscosity from pool storage tanks, process vessels, etc., requires tremendous suction for effective evacuation and different factors are involved. In home units, there is no possibility of injury to the user from the pull of the vacuum itself, little concern for corrosivity and little consideration for physical control of the vacuum head attachment itself. Much like a powerful fire hose, a commercial vacuum has such power and force that it can easily cause serious injury or even kill a user. For these reasons and others, it is believed that the home vacuum units for household cleaning, for removal of leaves and the like are not comparable to commercial units requiring different structures and drawing thousands of cubic feet per minute. Nonetheless, patents from the non-analogous art have been surveyed and are discussed herein as typical of advances in the low power vacuum area.

U.S. Pat. No. 3,135,986 to Tolin describes a vacuum cleaning tool which includes outwardly extending sidewalls and a sponge arrangement for a nozzle. U.S. Pat. No. 2,904,816 to Skolfield describes a rug vacuum cleaner with intake adjustment. U.S. Pat. No. 4,557,013 to Belmont describes a vacuum attachment with a squeegee on its leading edge. U.S. Pat. No. 3,938,217 to Hommes describes a surface cleaning pick head for a vacuum device with a suction increasing arrangement for picking up large objects of debris and litter. U.S. Pat. No. 3,862,469 to Burgoon describes an industrial vacuum cleaner with a two position flap for pick up of small objects in one position, and larger objects in the other position.

Notwithstanding the substantial prior art relating to vacuum attachments, the present invention system with infinite control and a housing with a fully open front and bottom is neither taught nor suggested.

SUMMARY OF THE INVENTION

The present invention involves a high power vacuum attachment apparatus with infinite adjustability and includes a housing with side walls, a top and a back, and with an open front and an open bottom. A gate located within the housing divides it into two compartments and is slidably mounted so as to be moved up and down within the housing. The top of the housing has an orifice through which an adjustment mechanism passes and is connected to the gate. Preferably, the side walls have a greater width at the open front than at the rear wall so as to taper rearwardly. Also, this attachment may include a vacuum pipe connected to the housing which functions as a handle, a vacuum line and may include an adjustable air valve. In preferred embodiments, squeegees are included along the bottoms of the housing walls.

BRIEF DESCRIPTION OF THE DRAWINGS

The present invention described in this specification is more fully understood when taken in conjunction with the appended drawings, wherein.

DETAILED DESCRIPTION OF THE INVENTION

The present invention has been developed to overcome serious problems existing in commercial, high power vacuum systems, especially those used in removal of fluids, such as petroleum products, liquid chemicals, high viscosity materials, water and contaminated water, aqueous solutions, etc.

Thus, it is an object of the present invention to provide a high power vacuum system with an attachment to replace conventional nozzles. It is also an object to provide such a system with a more maneuverable attachment and one which is easier to handle. It is also an object to provide an attachment which is safer for a user by at least partially shielding the vacuum line from the user to reduce suction injuries. It is further an object of the present invention to provide for an attachment which can evacuate very shallow levels of liquid not ordinarily easily evacuated with commercial units. It is also an object of the invention to provide for infinite control of the opening of the gate of the present invention apparatus to take into consideration necessary site characteristics such as liquid viscosity, suction rate, etc.

Figure 1:
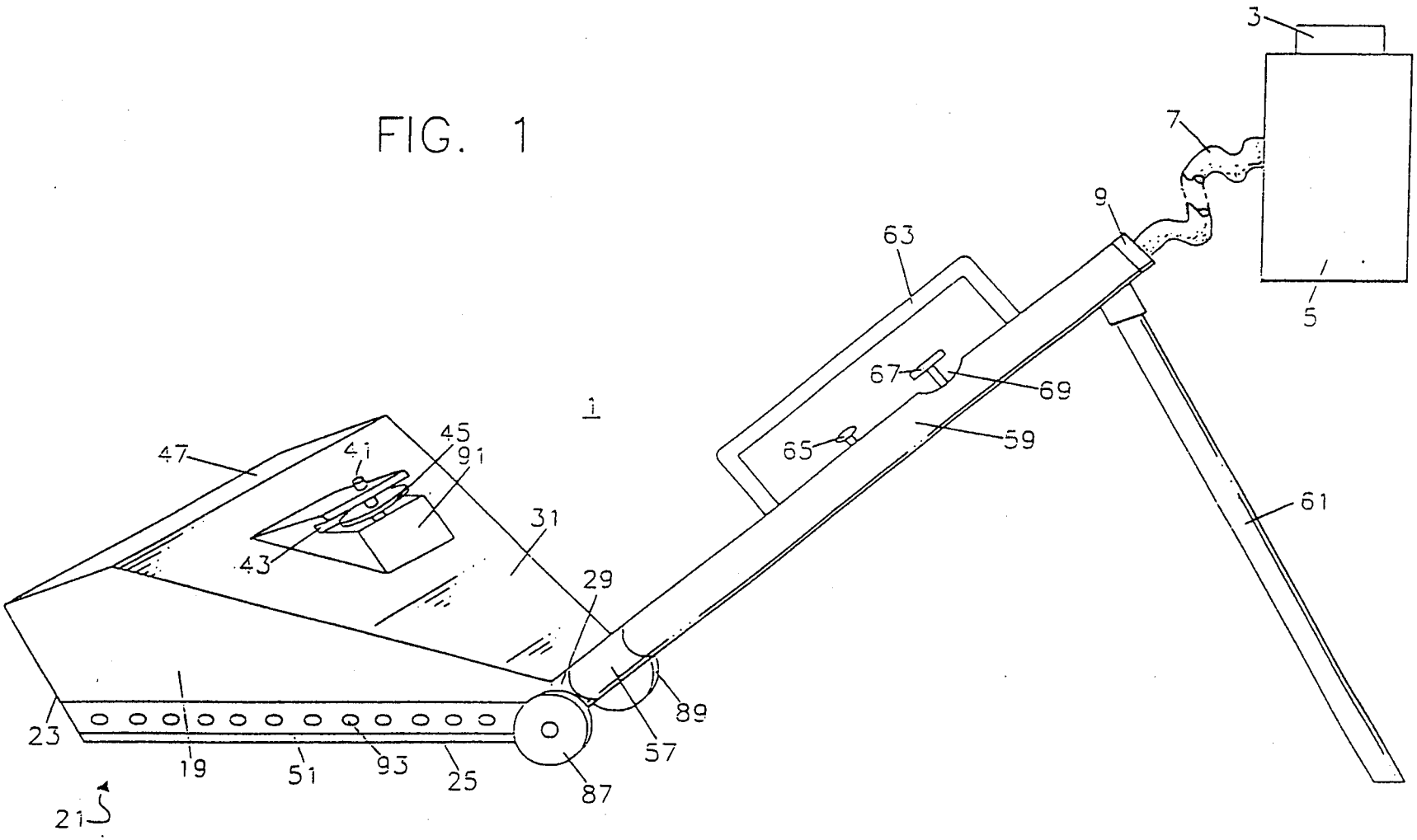
FIG. 1 shows a perspective view of a present invention high power vacuum system (schematic) with attachment.

Referring to FIG. 1, there is shown vacuum system 1 generally, with a high power vacuum pump 3 (schematic) and storage tank 5 (schematic), as well as flexible connecting pipe 7 and coupler 9. Attachment 21 includes open front 23, open bottom 25, left side wall 19 (right side wall not shown), rear wall 29, top 31 and safety lip 47. Walls 19 and 29 and right side wall (not shown), top 31 and safety lip 47 enclose attachment 21 except at open front 23 and open bottom 25. Left wheel 87 and right wheel 89 are provided at the bottom rear of the housing. Housing opening 43 and housing bracket 91 are located on housing top 31, through which adjustment rod 41 passes. Rotatable handle 45 is connected to adjustment rod 41 as shown. Squeegees, as typified by left bottom squeegee 51, are located about the bottom of the housing of attachment 21 and are riveted as shown by typical rivet 93 through the walls of housing attachment 21 to support plates (not shown) located on the lower inside walls of the housing of attachment 21.

In rear wall 27 is located an evacuation orifice (not shown) and this may be a conventional three inch or four inch outlet or the like. Coupler 57 extends the evacuation orifice (not shown) and connects to rigid vacuum pipe 59 with stand 61, handle 63, vacuum gauge 65 and air valve 67 located in pipe opening 69 for controlling line air intake for clearing the line or flexible pipe 7.

Attachment 21 may be constructed of high impact plastic or metal, such as rigid aluminum or stainless steel. Pump 3 may be a high power unit capable of evacuating at least 3000 cfm and as much as 5000 cfm or more.

Figure 2:
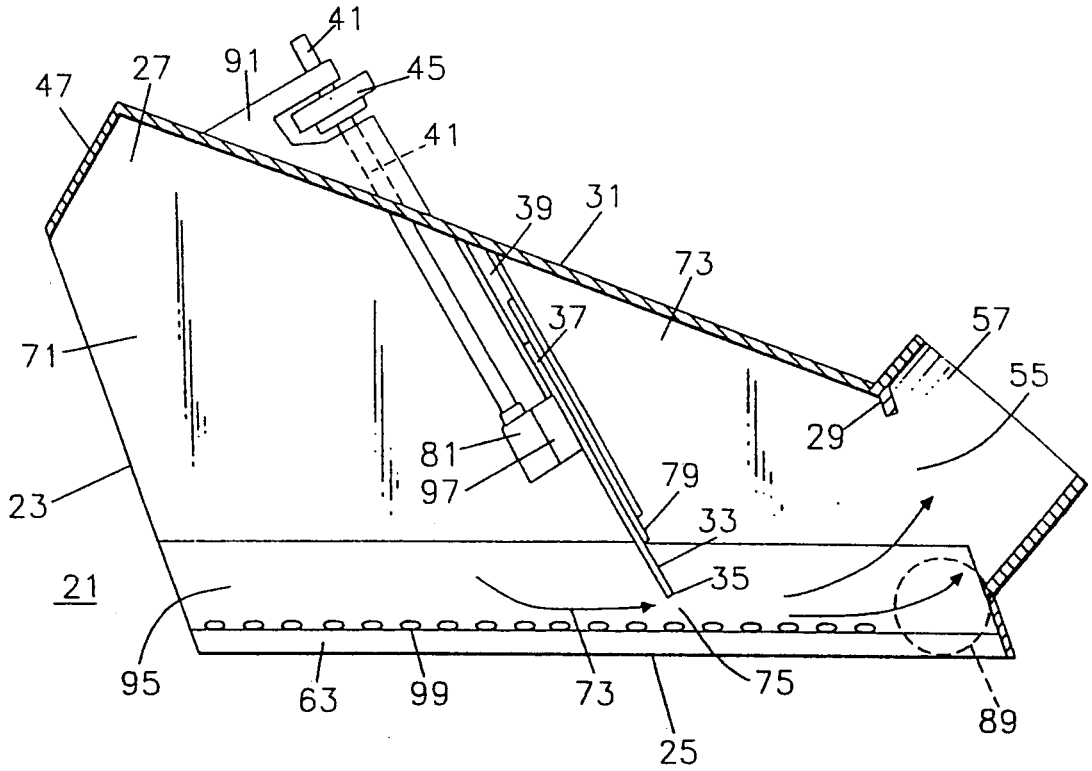
FIG. 2 shows a partially side cut view of a preferred present invention attachment.

FIG. 2 shows a partial side cut view of the attachment 21 of FIG. 1. Like parts are like numbered. This view exposes the inside surface of right wall 27 showing support plate 95 with right bottom squeegee 63 sandwiched between the support plate 95 and the inside of right wall 27 and riveted as shown by typical rivet 99. Right wheel 89 is shown on the outside bottom rear portion of right side wall 27. Gate 33 is movable upwardly and downwardly and has a bottom 35 and a top 37 with the gate bottom 35 biased rearwardly and the gate top 37 biased forwardly, as shown. Gate 33 is slidably mounted in airtight guide 39 (typical) and is in surface contact at its rear surface with slide plate 79 which is permanently mounted in airtight guide 39. The front surface of gate 33 is connected to adjustment rod 41 by means of gate bracket 97 and collar 81. Gate bracket 97 may be welded to collar 81 and front surface of gate 33 or attached by any other conventional means. Collar 81 fits around lower end of adjustment rod 41. In one preferred embodiment of the adjustment mechanism, collar 81 is fixedly attached to adjustment rod 41 and lower portion of rotatable handle 45 is a hollow tube threaded along its inside wall with matching threads located on adjustment rod 41. Thus, when rotatable handle 45 is turned, adjustment rod 41 moves up or down moving collar 81, gate bracket 97 and gate 33 along with it.

In another preferred embodiment of the adjustment mechanism, collar 81 is threaded on its inner surface and matching threads are located on adjustment rod 41. In this embodiment, rotatable handle 45 is fixedly attached to adjustment rod 41 and when rotated, collar 81 moves up or down adjustment rod 41 moving gate bracket 97 and gate 33 with it. Housing bracket 91 is located on housing top 31, through which adjustment rod 41 passes. Housing bracket 91 is recessed to accommodate rotatable handle 45.

Gate 33, in combination with slide plate 79, partially divides attachment enclosure into a forward compartment 71 and a rearward compartment 73 with passageway 75 therebetween. When nesting on the bottom of a tank or other liquid holding member, the liquid enters through the open front 23 and open bottom 25, passes through passageway 75, out of attachment housing through evacuation orifice 55 in rear wall 29 and into coupler 57 as shown by flow arrows typified by flow arrow 73.

By the use of the system of the present invention, the highest possible vacuum can be achieved by adjusting the size of the passageway under the gate, since volumetric flow rate is directly proportioned to the velocity multiplied by the area. In other words, decreasing the area increases the velocity given a specific suction and taking into account the viscosity of the liquid.

Figure 3:
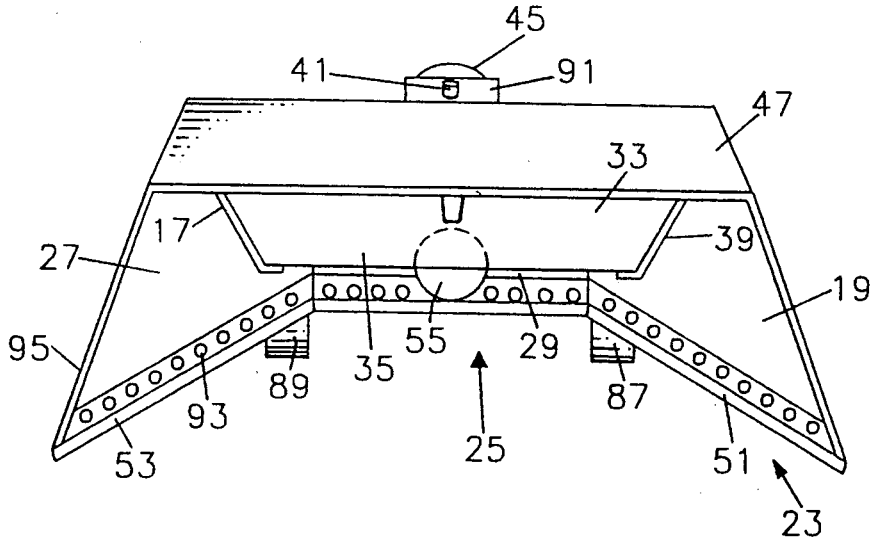
FIG. 3 illustrates a front view of a present invention attachment housing.

FIG. 3 shows a front view of the vacuum attachment 21 of FIGS. 1 and 2 wherein like parts are like numbered. In this view it can be seen that left side wall 19 and right side wall 27 taper outwardly from rear wall 29 toward open front 23. Gate 33 can be seen slidably mounted in airtight guides 17 and 39 with gate bottom 35 biased rearwardly. Evacuation orifice 55 is located in rear wall 29. Left and right wheels 87 and 89 can be seen at the bottom rear of the housing.

Figure 4:
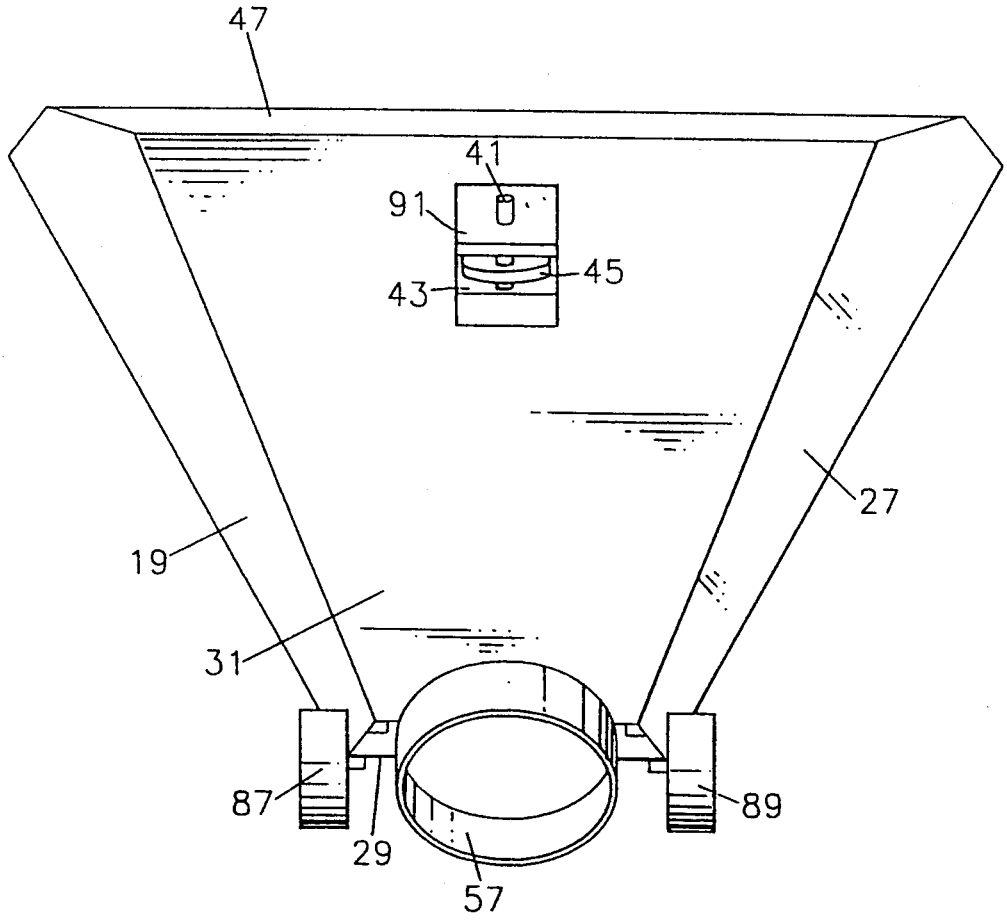
FIG. 4 shows a top view of a present invention attachment housing.

FIG. 4 shows a top view of the vacuum attachment of FIGS. 1 through 3. Like parts are like numbered. Adjustment rod 41 extends through housing bracket 91 and opening 43 in housing top 31 to the inside of the housing where it is connected to the gate (not shown). Rotatable handle 45 is connected to adjustment rod 41 on the outside of the housing as shown and is nested in the recess of housing bracket 91.

Obviously, numerous modifications and variations of the present invention are possible in light of the above teachings. It is therefore understood that within the scope of the appended claims, the invention may be practiced otherwise than as specifically described herein.

What is claimed is:

1. An attachment for a high power fluid vacuum system, which comprises:

(a) a housing having a left side wall, a right side wall, a rear wall connected to said left side wall and said right side wall, a top connected to all of the aforesaid walls to seal off its sides, top and rear, and having an open front and an open bottom, said front and said bottom being respectively substantially vertical and substantially horizontal, said rear wall having an evacuation orifice for connection to a vacuum system pipe;

(b) a gate dividing said housing into a forward compartment and a rearward compartment, and mounted within said housing between said open front and said rear wall, and being adjustably movable from the open bottom level upwardly so as to create a control for setting a passageway between said gate and any surface upon which said housing may rest to a predetermined size, and so as to thereby control vacuuming of shallow bodies of fluid, and so as to create a safety wall between said open front and said rear wall;

(c) an adjustment mechanism connected to said gate through the top of said housing so as to permit manual opening and closing adjustment of said gate from outside of said housing.

2. The attachment of claim 1, wherein said open front of said housing has a width greater than a width of a rear wall so that said left and right side walls taper outwardly from the rear wall to the open front.

3. The attachment of claim 2, wherein said gate is mounted at an angle so that it has a bottom which is biased rearwardly and a top which is biased forwardly.

4. The attachment of claim 1, wherein said side walls have bottom edges with squeegees attached thereto.

5. The attachment of claim 1, wherein said adjustment mechanism is a fixed threaded member connected to an orifice in said housing top and a matching threaded shaft through said member and connected to said gate inside said housing.

6. The attachment of claim 1, wherein said adjustment mechanism is a threaded shaft connected to said gate inside said housing, said threaded shaft extending through an opening in said housing top where it is threaded through a rotatable handle with matching threads.

7. The attachment of claim 1, wherein said adjustment mechanism is a threaded shaft with a matching threaded collar at its lower end, said collar connected by means of a gate bracket to said gate inside said housing, said threaded shaft extending through an opening in said housing top where it is fixedly attached to a rotatable handle.

8. The attachment of claim 1, further including:

(d) a vacuum pipe connected by a coupler to said rear wall evacuation orifice extending rearwardly and upwardly to form a handle for manual movement of said housing and adapted for connection to flexible piping of a fluid vacuum system.

9. The attachment of claim 8, wherein said vacuum pipe includes an opening and an adjustable valve connected thereto for opening and closing to permit cleaning of piping.

10. The attachment of claim 8, which further includes:

(e) a commercial vacuum system connected to said pipe and housing, having an intake of at least 3000 cubic feet per minute.

11. The attachment of claim 10 further including:

(g) wheels attached to the bottom rear of said side walls to facilitate said manual movement of said housing.

12. The attachment of claim 8, wherein said vacuum system intake is at least 5000 cubic feet per minute.

13. The attachment of claim 8 further including:

(f) wheels attached to the bottom rear of said side walls to facilitate said manual movement of said housing.

14. The attachment of claim 1, wherein said housing is constructed of non-corrosive metal.

15. The attachment of claim 1, wherein said housing is constructed of high strength plastic.

16. The attachment of claim 1, wherein said gate is mounted at an angle so that it has a bottom which is biased rearwardly and a top which is biased forwardly.

17. The attachment of claim 1, wherein said adjustment mechanism includes a movable handle for manual adjustment of said gate.

18. The attachment of claim 17, wherein said movable handle is rotatable.

* * * * *